US005365961A

United States Patent [19]

Bamber et al.

[11] Patent Number: 5,365,961

[45] Date of Patent: Nov. 22, 1994

[54] VENTILATOR FOR TENT

[75] Inventors: David J. Bamber; Martin W. Park, both of Wichita, Kans.

[73] Assignee: The Coleman Company, Inc., Wichita, Kans.

[21] Appl. No.: 168,142

[22] Filed: Dec. 17, 1993

[51] Int. Cl.[5] ..... E04H 15/10

[52] U.S. Cl. ..... 135/91; 135/94

[58] Field of Search ..... 135/91-94, 135/117, 114

[56] References Cited

U.S. PATENT DOCUMENTS

| | | | |
|---|---|---|---|
| 1,833,095 | 11/1931 | Smith | 135/91 |
| 2,345,377 | 3/1944 | Bowen . | |
| 3,164,078 | 1/1965 | Tao Sheng . | |
| 3,474,802 | 11/1969 | Loring | 135/104 |
| 3,800,814 | 4/1974 | Hibbert | 135/93 |
| 3,892,169 | 7/1975 | Jarnot | 135/93 X |
| 4,064,662 | 12/1977 | O'Toole . | |
| 4,165,757 | 8/1979 | Marks | 135/93 |
| 4,265,261 | 5/1981 | Barker . | |
| 4,898,085 | 2/1990 | Jarnot . | |

*Primary Examiner*—Lanna Mai

[57] ABSTRACT

A tent is provided with a ventilator opening in one corner thereof. The tent includes a pair of side panels which are secured together along a side seam and a top panel which is secured to the side panels along a top seam. One of the side panels is provided with an opening adjacent the top and side seams, and a screen covers the opening. A skirt is secured to the top and side seams and includes a free edge which is spaced from the screen. A stiffener is secured to the skirt adjacent the free edge thereof for maintaining the free edge away from the screen.

8 Claims, 1 Drawing Sheet

FIG. 1
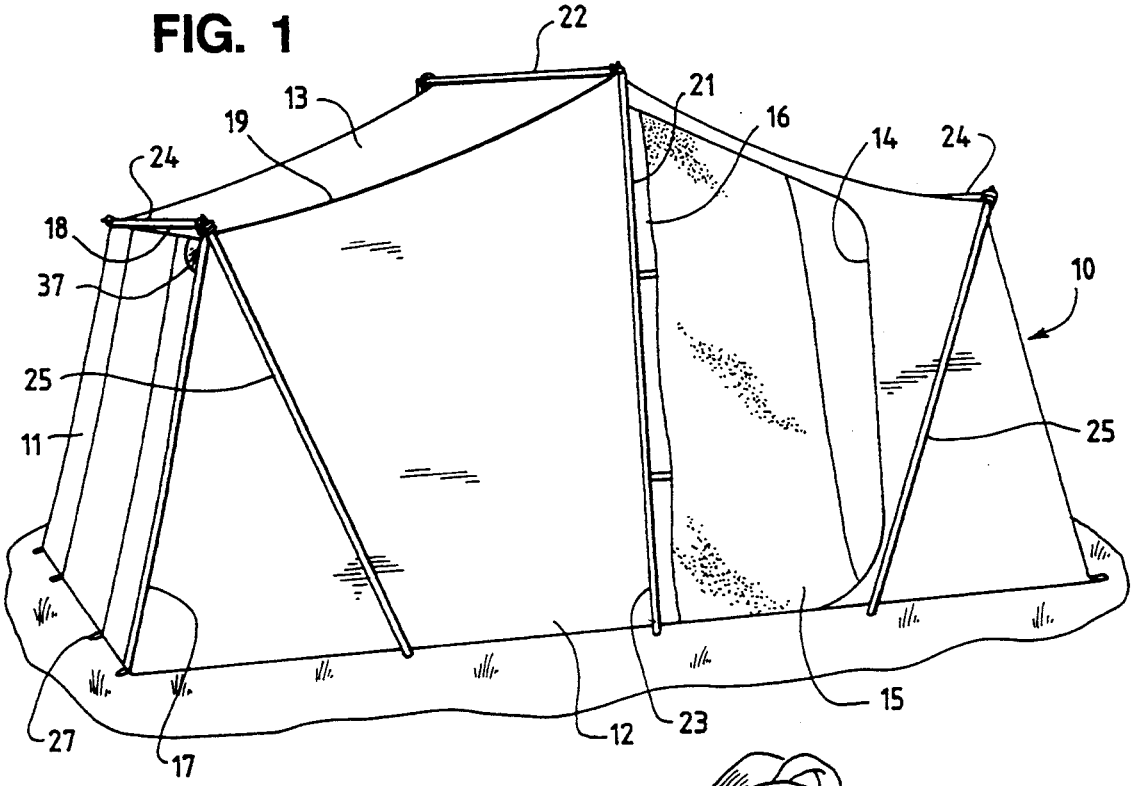
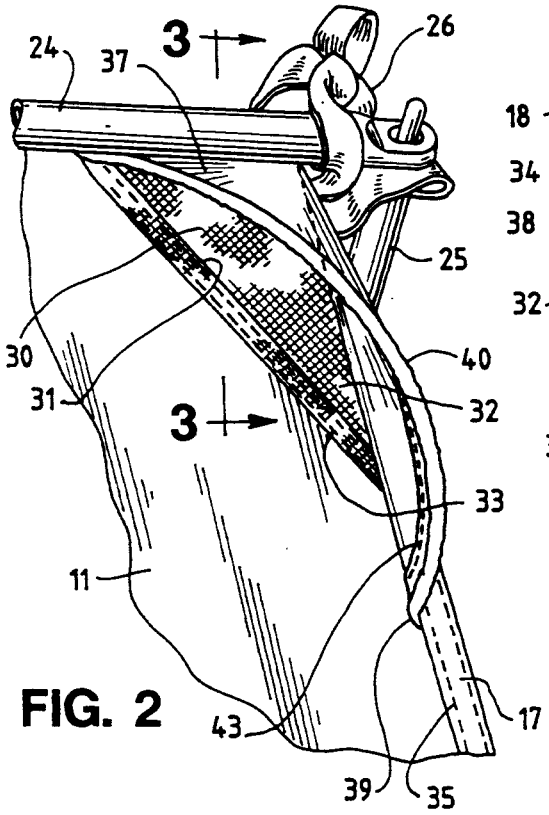
FIG. 2
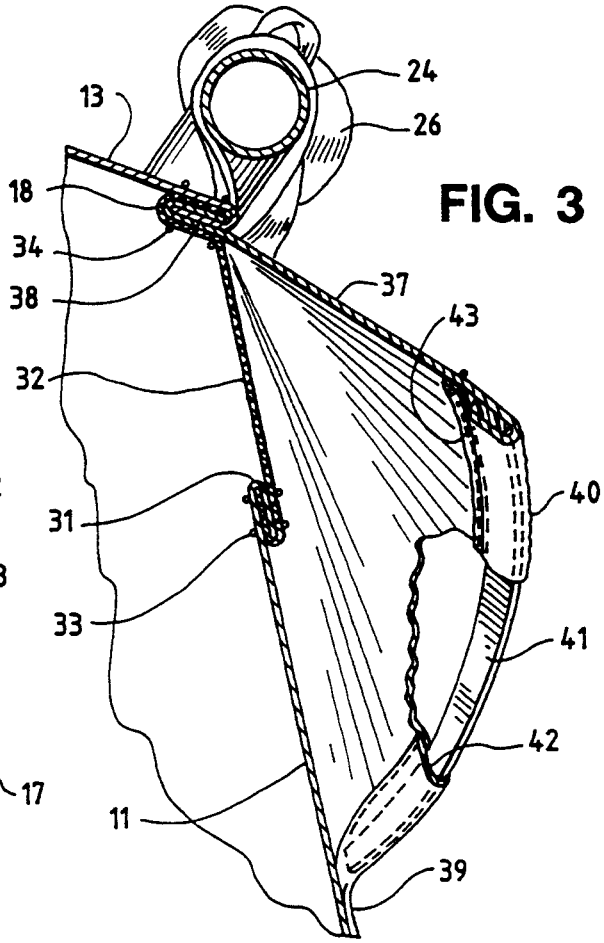
FIG. 3

VENTILATOR FOR TENT

BACKGROUND

This invention relates to tents, and, more particularly, to a tent which is provided with a ventilator opening.

Tents are commonly equipped with an entrance opening which can be closed with one or more flaps. However, when a tent is closed too tightly, condensation can form on the sidewalls of the tent and bad odors can build up. When the occupants of the tent or equipment stored in it come into contact with the walls, the condensate will get their clothing or sleeping bags wet. This is unpleasant and reduces the ability of the sleeping bags or clothing to protect against cold condition.

Although some tents have been provided with vent openings, such vents generally suffer one or more disadvantages. For example, the vent opening should be protected so that rain does not enter the tent through the vent. Also, the vent opening should function automatically so that a camper is not required to perform any manipulative steps when setting up the tent in order to obtain the advantages of the vent.

U.S Pat. No. 4,265,261 describes a tent with a large mesh-covered window in two sides of the tent. A pair of awning panels can be rolled up at the sides of the window or can be unrolled and secured together by Velcro fasteners. A stiffener rod can be inserted into the lower edge of each panel for holding an apex of the panels away from the window. The awning therefore requires various manipulative steps before it is operational.

U.S. Pat. No. 4,898,085 describes a vent which has a pointed end which pierces and cuts the tent. The opening which is provided by the vent is not screened.

U.S. Pat. No. 3,164,078 describes a ventilator which is inserted into a slit in the tent.

SUMMARY OF THE INVENTION

The invention provides a tent with a protected ventilator opening which functions when the tent is set up without any manipulative steps. The ventilator opening is advantageously provided in a corner of the tent where a pair of side panels are connected to a top panel. A screen covers the opening, and a skirt extends over the screen and prevents rain from passing through the screen. A stiffener or stay in the skirt spaces the skirt away from the screen.

DESCRIPTION OF THE DRAWING

The invention will be explained in conjunction with an illustrative embodiment shown in the accompanying drawing, in which FIG. 1 is a perspective view of a tent which is provided with a ventilator opening;

FIG. 2 is an enlarged fragmentary perspective view of the ventilator opening; and FIG. 3 is a fragmentary sectional view taken along the line 3—3 of FIG. 2.

DESCRIPTION OF SPECIFIC EMBODIMENTS

A tent 10 includes side panels 11 and 12 and a top panel 13. The tent also includes side panels opposite the panels 11 and 12, and the panels form an enclosure within the tent. The panels can be formed from nylon sheets or other conventional material.

The side panel 12 is provided with a window 14 which is covered by a screen or mesh 15, and the window can be covered by a flap 16 which is rolled up and tied in FIG. 1. A zipper is provided in the center of the side panel 12 for a door or entry opening.

The side panels 11 and 12 are stitched together along a side seam 17, and the top panel 13 is stitched to the side panel 11 along a top seam 18 and to the side panel 12 along a top seam 19.

The particular tent illustrated includes a truss frame 21 for supporting the tent. The frame includes a ridge pole 22, pair of support poles 23 for the ridge pole, a pair of end poles 24, and a pair of support poles 25 for each end pole. The top panel is tied to the ridge pole 22 and the end poles 24 by straps 26. The bottom edge of the side panel 11 is staked to the ground through loops 27.

The tent which has been described to this point is conventional, and the inventive ventilator opening can also be used with other types of tents.

The side panel 11 is provided with a triangular opening 30 at the corner of the tent where the side panels 11 and 12 and the top panel 13 meet. The opening is provided by an edge 31 of the panel 11 which extends from the top seam 18 to the side seam 17. A triangular sheet of mesh or screen 32 extends over the opening and is secured to the panel 11 adjacent the edge 31 by stitching 33 and is secured to the top seam 18 and side 17 by the stitches 34 and 35, respectively, which form the seams. The screen can be formed from polyvinylchloride or other conventional tent screening material.

A hooped skirt 37 extends over the screened opening and prevents rain from entering the opening. The skirt is formed from a triangular sheet which may be the same material as the material of the tent panels 11–13. The skirt includes a top edge 38 which is attached to the top panel 13 at the top seam 18, a side edge 39 which is attached to the side panels 11 and 12 at the side seam 17, and a free edge 40 which is spaced outwardly from the screen.

The free edge 40 of the skirt is maintained away from the screen by a flexible stay or stiffener 41 which is secured within a hem 42 on the skirt. The hem is formed by overlapping the free edge of the skirt around the stay and stitching at 43. The length of the free edge of the skirt and the length of the stay are greater than the distance between the points at which the free edge merges with and is attached to the top and side seams, and the flexible stay bows or curves outwardly between the seams. The stay is preferably formed with a curved shape which is retained by the memory of the plastic material of the stay.

The stay is formed from nylon plastic or other flexible and resilient material. The particular stay illustrated has the shape of a flat bar, but other shapes can be used.

The tent is preferably provided with at least two screened ventilator openings, located at opposed corners of the tent. Opposed ventilator openings promote cross-ventilation within the tent. However, even a single ventilator opening provides desirable ventilation.

Since the skirt 37 and the stay 41 are flexible, the tent can be rolled up and stowed without harming the skirt and stay. When the tent is unrolled and pitched, the resilient stay automatically assumes its bowed, protecting configuration illustrated in the drawing. No manual intervention by the camper is required to set up the skirt.

The distance of the free edge of the skirt from the corner formed by the top and bottom seams 18 and 17 is greater than the distance between the edge 31 of the screened opening and the corner. The skirt therefore extends beyond the edge of the opening and provides good protection for the opening.

While in the foregoing specification, a detailed description of a specific embodiment of the invention was set forth for the purpose of illustration, it will be understood that many of the details herein given may be varied considerably by those skilled in the art without departing from the spirit and scope of the invention.

We claim:

1. A tent having at least a pair of side panels and a top panel, the pair of side panels being secured together along a side seam, the top panel being secured to the side panels along a top seam, one of the side panels having an opening adjacent the side seam and the top seam, a screen covering the opening in said one side panel and secured to said one side panel and to said side seam and top seam, a skirt extending over the screen and having a first edge which is attached to the side seam, a second edge which is attached to the top seam, and a free edge which is spaced from said one side panel and the screen, and stiffening means secured to the skirt adjacent the free edge thereof for maintaining the free edge spaced from said one side panel and the screen.

2. The structure of claim 1 in which said stiffening means if a flexible and resilient plastic member.

3. The structure of claim 2 in which the skirt includes a hem which encloses the plastic member.

4. The structure of claim 1 in which said screen is generally triangular and includes a first edge which is secured to said one side panel, a second edge which is secured to said side seam, and a third edge which is secured to said top seam.

5. The structure of claim 1 in which the skirt includes a hem which encloses the stiffening means.

6. The structure of claim 1 in which the free edge of the skirt has a first end which is attached to the side seam and a second end which is attached to the top seam, the length of the stiffening means being greater than the distance between the first and second ends of the free edge so that the skirt curves from the side seam to the top seam.

7. The structure of claim 6 in which the stiffening means is a flexible and resilient plastic member whereby the tent can be rolled up without damaging the stiffening member.

8. The structure of claim 1 in which the intersection of said side and top seams forms a corner of the tent, said free edge of the skirt being spaced from the corner sufficiently to overlap the screen.

* * * * *